US011572676B2

(12) United States Patent
Wu

(10) Patent No.: US 11,572,676 B2
(45) Date of Patent: Feb. 7, 2023

(54) SHOVEL

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 353 days.

(21) Appl. No.: 16/896,396

(22) Filed: Jun. 9, 2020

(65) Prior Publication Data

US 2020/0299933 A1 Sep. 24, 2020

Related U.S. Application Data

(63) Continuation of application No. PCT/JP2017/044610, filed on Dec. 12, 2017.

(51) Int. Cl.

| | |
|---|---|
| ***E02F 9/24*** | (2006.01) |
| ***E02F 3/32*** | (2006.01) |
| ***E02F 3/43*** | (2006.01) |
| ***E02F 9/20*** | (2006.01) |
| *E02F 9/22* | (2006.01) |

(52) U.S. Cl.

CPC ..... *E02F 9/24* (2013.01); *E02F 3/32* (2013.01); *E02F 3/435* (2013.01); *E02F 9/2033* (2013.01); *E02F 9/2203* (2013.01)

(58) Field of Classification Search

CPC ..... E02F 3/28; E02F 3/32; E02F 3/435; E02F 9/2029; E02F 9/2033; E02F 9/2203; E02F 9/226; E02F 9/24; E02F 9/265

See application file for complete search history.

(56) References Cited

U.S. PATENT DOCUMENTS 4,465,425 A * 8/1984 Schwappach ..... E02F 3/425 414/710

5,493,798 A 2/1996 Rocke et al.

(Continued)

FOREIGN PATENT DOCUMENTS

JP H04-350220 12/1992
JP H05-263436 10/1993

(Continued)

OTHER PUBLICATIONS

International Search Report for PCT/JP2017/044610 dated Feb. 27, 2018.

*Primary Examiner* — Tyler J Lee

(74) *Attorney, Agent, or Firm* — IPUSA, PLLC

(57) ABSTRACT

A shovel includes a lower traveling body, an upper turning body mounted on the lower traveling body, an excavation attachment attached to the upper turning body, a posture detecting device configured to detect the posture of the excavation attachment, an instability detecting device configured to detect information on the instability of the upper turning body due to an excavation load, and a processor configured to correct the posture of the excavation attachment. The processor is configured to open an arm or a bucket of the excavation attachment in response to determining, based on the outputs of the posture detecting device and the instability detecting device, that the excavation load during deep excavation is more than or equal to a predetermined value.

14 Claims, 9 Drawing Sheets

(56) References Cited

U.S. PATENT DOCUMENTS

| | | | | |
|---|---|---|---|---|
| 6,275,757 | B1 * | 8/2001 | Watanabe | E02F 9/2296 37/234 |
| 6,568,898 | B2 * | 5/2003 | Nishimura | E02F 3/964 414/694 |
| 8,939,699 | B2 * | 1/2015 | Tsukane | E02F 3/425 298/22 C |
| 9,382,687 | B2 | 7/2016 | Tsukamoto | |
| 10,081,928 | B2 * | 9/2018 | Wu | E02F 9/22 |
| 10,710,630 | B2 * | 7/2020 | Riot | B62D 7/1563 |
| 2007/0260380 | A1 * | 11/2007 | Mintah | G01G 19/083 701/50 |
| 2010/0034630 | A1 * | 2/2010 | Kobata | E02F 9/2228 414/694 |
| 2011/0150615 | A1 * | 6/2011 | Ishii | E02F 3/965 701/50 |
| 2014/0320293 | A1 * | 10/2014 | Hunter, Jr. | E02F 3/96 340/626 |
| 2015/0275469 | A1 * | 10/2015 | Fredrickson | E02F 9/265 701/50 |
| 2017/0101761 | A1 * | 4/2017 | Wu | E02F 9/22 |

FOREIGN PATENT DOCUMENTS

| | | |
|---|---|---|
| JP | H06-073761 | 3/1994 |
| JP | H08-049265 | 2/1996 |
| JP | 2002-304441 | 10/2002 |
| JP | 2011-252338 | 12/2011 |
| JP | 2014-122511 | 7/2014 |
| JP | 2016-169572 | 9/2016 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2017/044610, filed on Dec. 12, 2017 and designating the U.S., which is based on Japanese patent application No. 2016-121176, filed on Jun. 17, 2016. The entire contents of the foregoing applications are incorporated herein by reference.

BACKGROUND

Technical Field

The present disclosure relates to shovels.

Description of Related Art

A shovel that can determine whether an overload has occurred in an excavating operation by determining an excavation reaction force from the position and posture of work elements such as a boom, an arm, and a bucket without attaching a load detector to the work elements and control the motion of the work elements is known.

This shovel prevents an excavating operation from being interrupted by reducing an excavation reaction force by automatically raising a boom during the excavating operation to reduce the depth of excavation when a calculated excavation reaction force is greater than a preset upper limit value.

SUMMARY

According to an aspect of the present invention, a shovel includes a lower traveling body, an upper turning body mounted on the lower traveling body, an excavation attachment attached to the upper turning body, a posture detecting device configured to detect the posture of the excavation attachment, an instability detecting device configured to detect information on the instability of the upper turning body due to an excavation load, and a processor configured to correct the posture of the excavation attachment. The processor is configured to open an arm or a bucket of the excavation attachment in response to determining, based on the outputs of the posture detecting device and the instability detecting device, that the excavation load during deep excavation is more than or equal to a predetermined value.

DETAILED DESCRIPTION

Reducing the depth of excavation by raising a boom during deep excavation, however, may increase an excavation reaction force instead. In this respect, the related-art shovel raises the boom irrespective of whether performing deep excavation or noLlual excavation when the calculated excavation reaction force is greater than a preset upper limit value. Therefore, the related-art shovel may increase the excavation reaction force instead of reducing the excavation reaction force during deep excavation, thus preventing the deep excavation from being continued to reduce work efficiency.

In view of the above, it is desired to provide a shovel that can control an excavation attachment more appropriately during deep excavation.

According to an aspect of the present invention, a shovel that can control an excavation attachment more appropriately during deep excavation is provided.

Figure 1:
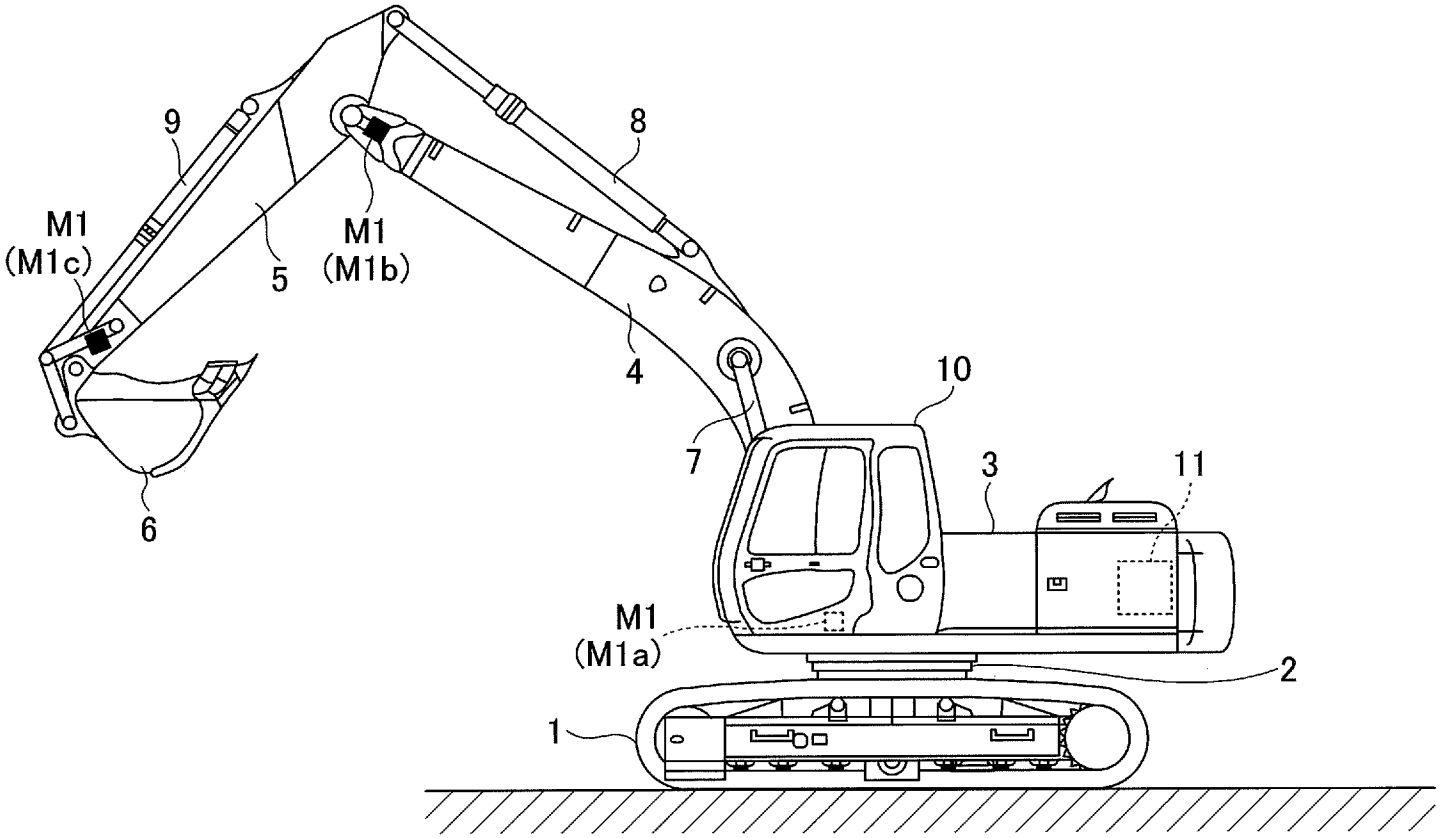
FIG. 1 is a side view of a shovel according to an embodiment of the present invention.

First, a shovel (excavator) as a construction machine according to an embodiment of the present invention is described with reference to FIG. 1. FIG. 1 is a side view of the shovel according to the embodiment of the present invention. On a lower traveling body 1 of the shovel illustrated in FIG. 1, an upper turning body 3 is turnably mounted through a turning mechanism 2. A boom 4 is attached to the upper turning body 3. An arm 5 is attached to the end of the boom 4, and a bucket 6 is attached to the end of the arm 5. The boom 4, the arm 5, and the bucket 6 as work elements constitute an excavation attachment that is an example of an attachment. The boom 4, the arm 5, and the bucket 6 are hydraulically driven by a boom cylinder 7, an arm cylinder 8, and a bucket cylinder 9, respectively. A cabin 10 is provided on and a power source such as an engine 11 is mounted on the upper turning body 3.

A posture detecting device M1 is attached to the excavation attachment. The posture detecting device M1 is a device to detect the posture of the excavation attachment. According to this embodiment, the posture detecting device M1 includes a boom angle sensor M1*a*, an arm angle sensor M1*b*, and a bucket angle sensor M1*c*.

The boom angle sensor M1*a* is a sensor to obtain a boom angle, whose examples include a rotation angle sensor to detect the rotation angle of a boom foot pin, a stroke sensor to detect the stroke amount of the boom cylinder 7, a tilt (acceleration) sensor to detect the inclination angle of the boom 4, etc. The boom angle sensor M1*a* may be an inertial measurement unit composed of a combination of a gyro sensor and an acceleration sensor. The same applies to the arm angle sensor M1*b* and the bucket angle sensor M1*c*.

Figure 2:
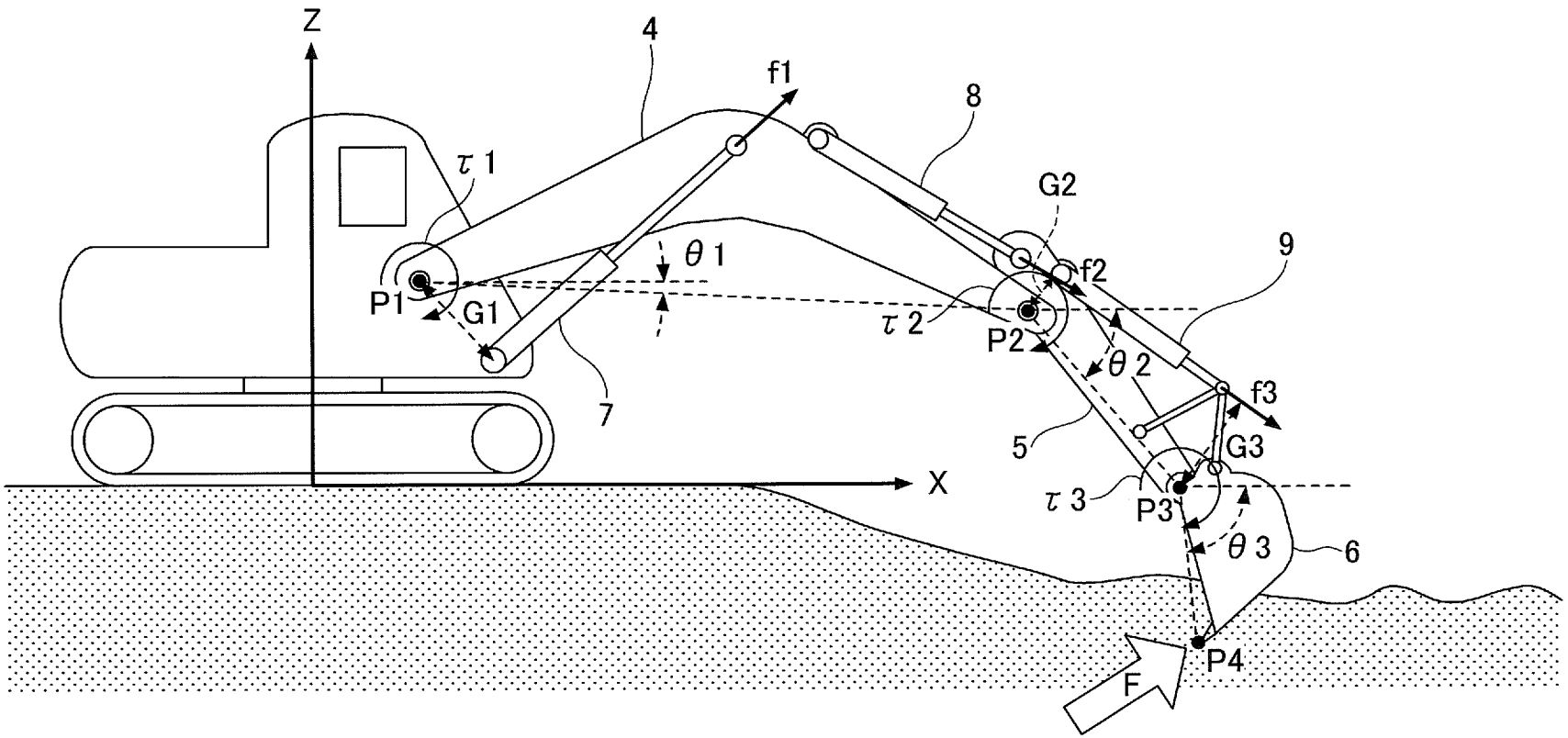
FIG. 2 is a side view of the shovel of FIG. 1, illustrating physical quantities associated with an excavation attachment of the shovel.

FIG. 2 is a side view of the shovel, illustrating various physical quantities related to the excavation attachment. The boom angle sensor M1*a* obtains, for example, a boom angle (θ1). The boom angle (θ1) is the angle of a line segment P1-P2 connecting a boom foot pin position P1 and an arm link pin position P2 to a horizontal line in the XZ plane. The arm angle sensor M1*b* is a sensor to obtain an a arm angle (θ2). The arm angle (θ2) is the angle of a line segment P2-P3 connecting the arm link pin position P2 and a bucket link pin position P3 to a horizontal line in the XZ plane. The bucket angle sensor M1*c* obtains, for example, a bucket angle (θ3). The bucket angle (θ3) is the angle of a line segment P3-P4 connecting the bucket link pin position P3 and a bucket teeth tips position P4 to a horizontal line in the XZ plane.

Figure 3:
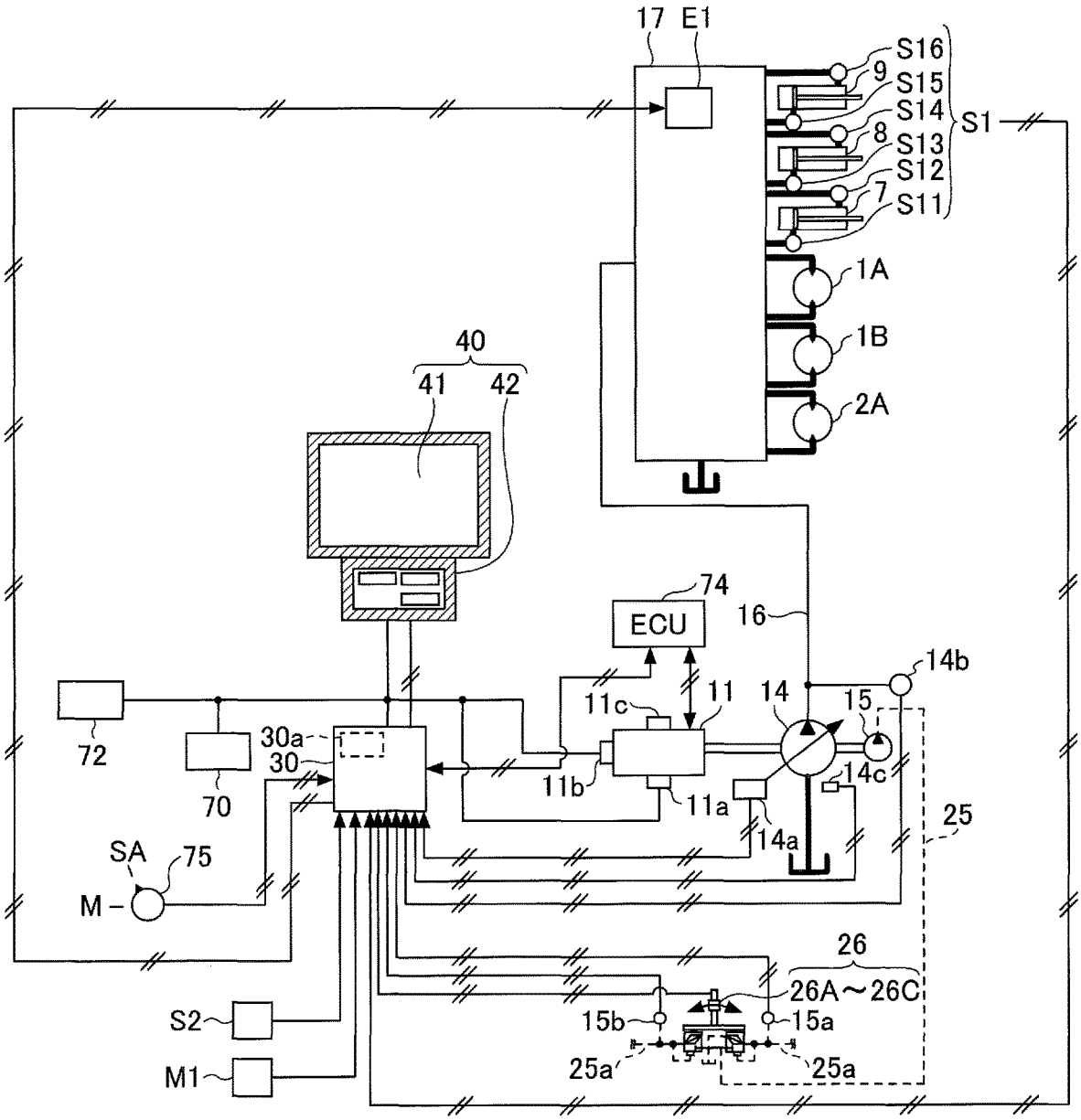
FIG. 3 is a diagram illustrating an example configuration of a basic system installed in the shovel of FIG. 1.

Next, a basic system of the shovel is described with reference to FIG. 3. The basic system of the shovel mainly includes the engine 11, a main pump 14, a pilot pump 15, a control valve 17, an operating apparatus 26, a controller 30, an engine control unit (ECU) 74, etc.

The engine 11 is a drive source of the shovel, and is, for example, a diesel engine that operates in such a manner as to maintain a predetermined rotational speed. The output shaft of the engine 11 is connected to the input shafts of the main pump 14 and the pilot pump 15.

The main pump 14 is a hydraulic pump that supplies hydraulic oil to the control valve 17 via a hydraulic oil line 16, and is, for example, a swash plate variable displacement hydraulic pump. According to a swash plate variable displacement hydraulic pump, as the swash plate tilt angle changes, the stroke length of a piston that defines geometric displacement changes to change a discharge flow rate per revolution. The swash plate tilt angle is controlled by a regulator 14*a*. The regulator 14*a* changes the swash plate tilt angle in accordance with a change in a control electric current from the controller 30. For example, as the control electric current increases, the regulator 14*a* increases the swash plate tilt angle to increase the discharge flow rate of the main pump 14. As the control electric current decreases, the regulator 14*a* decreases the swash plate tilt angle to decrease the discharge flow rate of the main pump 14. A discharge pressure sensor 14*b* detects the discharge pressure of the main pump 14. An oil temperature sensor 14*c* detects the temperature of hydraulic oil drawn in by the main pump 14.

The pilot pump 15 is a hydraulic pump for supplying hydraulic oil to various hydraulic control apparatus such as the operating apparatus 26 via a pilot line 25, and is, for example, a fixed displacement hydraulic pump.

The control valve 17 is a set of flow control valves that control the flow of hydraulic oil with respect to hydraulic actuators. The control valve 17 selectively supplies hydraulic oil received from the main pump 14 through the hydraulic oil line 16 to one or more hydraulic actuators in accordance with a change in a pilot pressure commensurate with the direction of operation and the amount of operation of the operating apparatus 26. The hydraulic actuators include, for example, the boom cylinder 7, the arm cylinder 8, the bucket cylinder 9, a left hydraulic travel motor 1A, a right hydraulic travel motor 1B, and a turning hydraulic motor 2A.

The operating apparatus 26 is an apparatus that an operator uses to operate the hydraulic actuators, and includes a lever 26A, a lever 26B, a pedal 26C, etc. The operating apparatus 26 receives hydraulic oil supplied from the pilot pump 15 via the pilot line 25 to generate a pilot pressure, and causes the pilot pressure to act on a pilot port of a corresponding flow control valve through a pilot line 25*a*. The pilot pressure changes in accordance with the direction of operation and the amount of operation of the operating apparatus 26. The operating apparatus 26 may be remotely controlled. In this case, the operating apparatus 26 generates a pilot pressure in accordance with information on the direction of operation and the amount of operation received through radio communications.

The controller 30 is a control device for controlling the shovel. According to this embodiment, the controller 30 is composed of a computer including a CPU, a RAM, a ROM, etc. The CPU of the controller 30 reads programs corresponding to various functions from the ROM, loads the programs into the RAM, and executes the programs, thereby implementing the functions corresponding to the programs.

For example, the controller 30 implements a function to control the discharge flow rate of the main pump 14. Specifically, the controller 30 changes a control electric current to the regulator 14*a* in accordance with the negative control pressure of a negative control valve, and controls the discharge flow rate of the main pump 14 via the regulator 14*a*.

The engine control unit 74 is a device to control the engine 11. For example, the engine control unit 74 controls the amount of fuel injection, etc., so that an engine rotational speed set through an input device is achieved.

An operating mode switching dial 75 is a dial for switching the operating mode of the shovel, and is provided in the cabin 10. According to this embodiment, the operator can switch between M (manual) mode and SA (semi-automatic) mode. For example, the controller 30 switches the operating mode of the shovel in accordance with the output of the operating mode switching dial 75. FIG. 3 illustrates a state where the SA mode is selected by the operating mode switching dial 75.

The M mode is a mode to cause the shovel to operate in accordance with the details of an operation input to the operating apparatus 26 by the operator. For example, the M mode is a mode to cause the boom cylinder 7, the arm cylinder 8, the bucket cylinder 9, etc., to operate in accordance with the details of an operation input to the operating apparatus 26 by the operator. The SA mode is a mode to cause the shovel to automatically operate irrespective of the details of an operation input to the operating apparatus 26 when a predeteiiuined condition is satisfied. For example, the SA mode is a mode to cause the boom cylinder 7, the arm cylinder 8, the bucket cylinder 9, etc., to automatically operate irrespective of the details of an operation input to the operating apparatus 26 when a predetermined condition is satisfied. The operating mode switching dial 75 may be configured to enable switching among three or more operating modes.

A display device 40 is a device to display various kinds of information, and is placed near an operator seat in the cabin 10. According to this embodiment, the display device 40 includes an image display part 41 and an input part 42. The operator can input information and commands to the controller 30 using the input part 42. Furtheimore, the operator can look at the image display part 41 to understand the operating situation and control infoimation of the shovel. The display device 40 is connected to the controller 30 via a communications network such as a CAN. The display device 40 may be connected to the controller 30 via a dedicated line.

The display device 40 is supplied with electric power from a rechargeable battery 70 to operate. The rechargeable battery 70 is charged with electric power generated by an alternator 11*a*. The electric power of the rechargeable battery 70 is also supplied to electrical equipment 72, etc., of the shovel besides the controller 30 and the display device 40. A starter 11*b* of the engine 11 is driven with electric power from the rechargeable battery 70 to start the engine 11.

The engine 11 is controlled by the engine control unit 74. The engine control unit 74 transmits various data indicating the condition of the engine 11 (for example, data indicating coolant water temperature (a physical quantity) detected with a water temperature sensor 11*c*) to the controller 30. The controller 30 can store these data in a temporary storage part (memory) 30*a* and transmit the data to the display device 40 when needed. The same applies to data indicating the swash plate tilt angle output by the regulator 14*a*, data indicating the discharge pressure of the main pump 14 output by the discharge pressure sensor 14*b*, data indicating hydraulic oil temperature output by the oil temperature sensor 14*c*, data indicating a pilot pressure output by a pilot pressure sensor 15*a* or 15*b*, etc.

A cylinder pressure sensor S1, which is an example of an instability detecting device to detect information on the instability of the upper turning body 3 due to an excavation load, detects the cylinder pressure of a hydraulic cylinder and outputs detection data to the controller 30. The instability of the upper turning body 3 includes a condition where the rear end of the upper turning body 3 is likely to be lifted. Examples of cylinder pressures include a boom cylinder pressure, an arm cylinder pressure, and a bucket cylinder pressure. According to this embodiment, the cylinder pressure sensor S1 includes cylinder pressure sensors S11 through S16. Specifically, the cylinder pressure sensor S11 detects a boom bottom pressure that is a hydraulic oil pressure in the bottom-side oil chamber of the boom cylinder 7. The cylinder pressure sensor S12 detects a boom rod pressure that is a hydraulic oil pressure in the rod-side oil chamber of the boom cylinder 7. Likewise, the cylinder pressure sensor S13 detects an arm bottom pressure, the cylinder pressure sensor S14 detects an arm rod pressure, the cylinder pressure sensor S15 detects a bucket bottom pressure, and the cylinder pressure sensor S16 detects a bucket rod pressure. A boom cylinder pressure includes the boom rod pressure and the boom bottom pressure. An arm cylinder pressure includes the arm rod pressure and the arm bottom pressure. A bucket cylinder pressure includes the bucket rod pressure and the bucket bottom pressure.

A control valve E1 is a valve that operates in response to a command from the controller 30. According to this embodiment, the control valve E1 is used to force a flow control valve associated with a predetermined hydraulic cylinder to operate irrespective of the details of an operation input to the operating apparatus 26.

Figure 4:
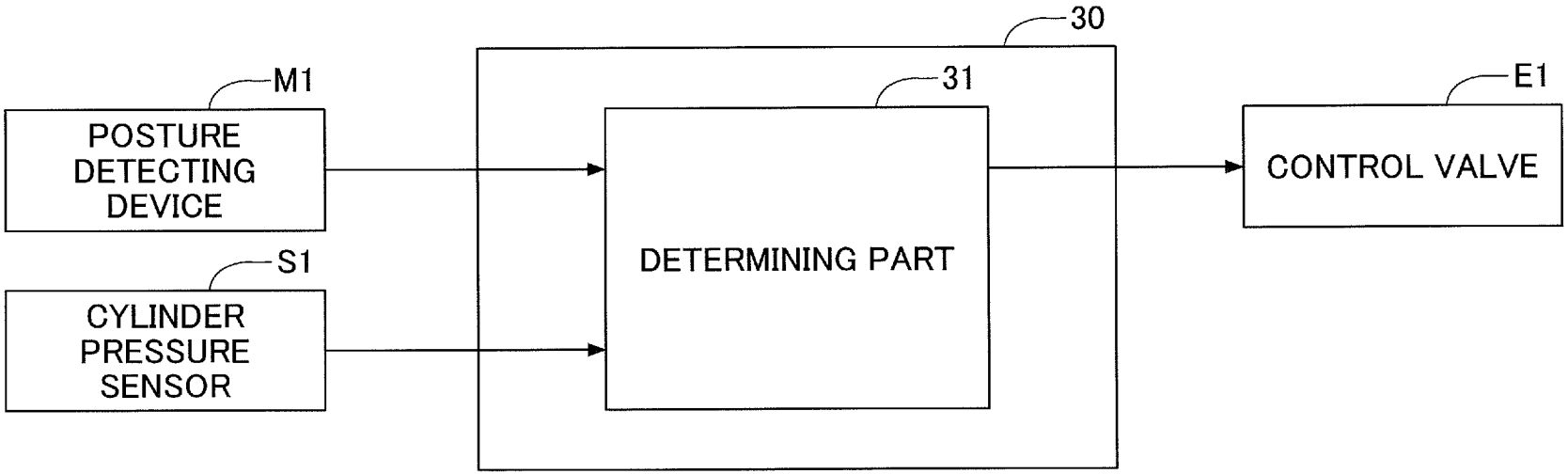
FIG. 4 is a diagram illustrating an example configuration of an excavation control system installed in the shovel of FIG. 1.

FIG. 4 is a diagram illustrating an example configuration of an excavation control system installed in the shovel of FIG. 1. The excavation control system is composed mainly of the posture detecting device M1, the cylinder pressure sensor S1, the controller 30, and the control valve E1. The controller 30 includes a determining part 31.

The determining part 31 is a functional element to determine whether to correct the posture of the excavation attachment during excavation. For example, the determining part 31 determines to correct the posture of the excavation attachment during excavation in response to determining that an excavation load may become excessively large.

According to this embodiment, the determining part 31 derives an excavation load based on the output of the cylinder pressure sensor S1, and records the excavation load. Furthermore, the determining part 31 derives an empty excavation load corresponding to the posture of the excavation attachment detected by the posture detecting device M1. The determining part 31 calculates a net excavation load by subtracting the empty excavation load from the excavation load, and determines whether to correct the posture of the excavation attachment based on the net excavation load. The determining part 31 may consider the inclination of the upper turning body 3 detected by a body tilt sensor S2 that is another example of the instability detecting device when deriving the empty excavation load. Examples of the body tilt sensor S2 include an acceleration sensor, a gyro sensor, and an inertia measuring device.

"Excavation" means moving the excavation attachment while keeping the excavation attachment in contact with an excavation target such as soil, and "empty excavation" means moving the excavation attachment while keeping the excavation attachment out of contact with any feature.

"Excavation load" means a load in the case of moving the excavation attachment while keeping the excavation attachment in contact with an excavation target, and "empty excavation load" means a load in the case of moving the excavation attachment while keeping the excavation attachment out of contact with any feature. "Excavation load" is also referred to as "excavation resistance."

Each of "excavation load," "empty excavation load," and "net excavation load" is represented by a desired physical quantity such as a cylinder pressure, a cylinder thrust, an excavation torque (the moment of an excavation force), or an excavation reaction force. For example, a net cylinder pressure serving as the net excavation load is expressed as a value obtained by subtracting an empty excavation cylinder pressure serving as the empty excavation load from a cylinder pressure serving as the excavation load. The same is true for the case of using a cylinder thrust, an excavation torque (the moment of an excavation force), or an excavation reaction force.

For example, the detection value of the cylinder pressure sensor S1 is used as the cylinder pressure. Examples of the detection value of the cylinder pressure sensor S1 include the boom bottom pressure (P11), the boom rod pressure (P12), the arm bottom pressure (P13), the arm rod pressure (P14), the bucket bottom pressure (P15), and the bucket rod pressure (P16) detected by the cylinder pressure sensors S11 through S16.

The cylinder, thrust is calculated based on, for example, the cylinder pressure and the pressure receiving area of a piston that slides in a cylinder. For example, as illustrated in FIG. 2, a boom cylinder thrust (f1) is represented by the difference between a cylinder extension force and a cylinder retraction force (P11×A11−P12×A12), where the cylinder extension force is the product (P11×A11) of the boom bottom pressure (P11) and the pressure receiving area of a piston in the boom bottom-side oil chamber (A11) and the cylinder retraction force is the product (P12×Al2) of the boom rod pressure (P12) and the pressure receiving area of the piston in the boom rod-side oil chamber (A12). The same is true for an arm cylinder thrust (f2) and a bucket cylinder thrust (f3).

The excavation torque is calculated based on, for example, the posture of the excavation attachment and the cylinder thrust. For example, as illustrated in FIG. 2, the size of a bucket excavation torque ($\tau$3) is represented by a value obtained by multiplying the size of a bucket cylinder thrust (f3) by a distance G3 between the line of action of the bucket cylinder thrust (f3) and the bucket link pin position P3. The distance G3 is a function of the bucket angle ($\theta$3) and is an example of link gain. The same is true for a boom excavation torque ($\tau$1) and an arm excavation torque ($\tau$2).

The excavation reaction force is calculated based on, for example, the posture of the excavation attachment and the excavation load. For example, an excavation reaction force F is calculated based on a function having an argument that is a physical quantity representing the posture of the excavation attachment (mechanism function) and a function having an argument that is a physical quantity representing the excavation load. Specifically, the excavation reaction force F is calculated as the product of a mechanism function whose arguments are the boom angle (θ1), the arm angle (θ2), and the bucket angle (θ3) and a function whose arguments are the boom excavation torque (τ1), the arm excavation torque (τ2), and the bucket excavation torque (τ3) as illustrated in FIG. 2. The function whose arguments are the boom excavation torque (τ1), the arm excavation torque (τ2), and the bucket excavation torque (τ3) may be a function whose arguments are the boom cylinder thrust (f1), the arm cylinder thrust (f2), and the bucket cylinder thrust (f3).

The function whose arguments are the boom angle (θ1), the arm angle (θ2), and the bucket angle (θ3) may be based on the equation of equilibrium of forces, based on the Jacobian, or based on the principle of virtual work.

Thus, the excavation load is derived based on the current detection values of various sensors. For example, the detection value of the cylinder pressure sensor S1 may be directly used as the excavation load. Alternatively, the cylinder thrust calculated based on the detection value of the cylinder pressure sensor S1 may be used as the excavation load. Alternatively, the excavation torque calculated from the cylinder thrust calculated based on the detection value of the cylinder pressure sensor S1 and the posture of the excavation attachment derived based on the detection value of the posture detecting device M1 may be used as the excavation load. The same is true for the excavation reaction force.

The empty excavation load may be prestored in correlation with the posture of the excavation attachment. For example, an empty excavation cylinder pressure table that stores the empty excavation cylinder pressure serving as the empty excavation load in correlation with a combination of the boom angle (θ1), the arm angle (θ2), and the bucket angle (θ3) in such a manner as to allow the empty excavation cylinder pressure to be referred to may be used. Alternatively, an empty excavation cylinder thrust table that stores an empty excavation cylinder thrust serving as the empty excavation load in correlation with a combination of the boom angle (θ1), the arm angle (θ2), and the bucket angle (θ3) in such a manner as to allow the empty excavation cylinder thrust to be referred to may be used. The same is true for an empty excavation torque table and an empty excavation reaction force table. The empty excavation cylinder pressure table, the empty excavation cylinder thrust table, the empty excavation torque table, the empty excavation reaction force table, etc., may be, for example, generated based on data acquired when an actual shovel perfo/ms empty excavation and prestored in the ROM or the like of the controller 30, or may be generated based on simulation results derived by a simulator apparatus such as a shovel simulator. Alternatively, a calculation formula such as a multiple regression equation based on a multiple regression analysis may be used instead of a reference table. In the case of using a multiple regression analysis, the empty excavation load is calculated in real time, based on a current combination of the boom angle (θ1), the arm angle (θ2), and the bucket angle (θ53), for example.

Furthermore, the empty excavation cylinder pressure table, the empty excavation cylinder thrust table, the empty excavation torque table, and the empty excavation reaction force table may be prepared for each of the operating speeds of the excavation attachment, such as high speed, middle speed, and low speed, and may also be prepared for each of the motions of the excavation attachment, such as an arm closing time, an arm opening time, a boom raising time, and a boom lowering time.

When a current net excavation load is more than or equal to a predetermined value (predetermined load), the determining part 31 determines that the excavation load is likely to become excessive. For example, when a net cylinder pressure as the net excavation load is more than or equal to a predetermined cylinder pressure, the determining part 31 determines that the cylinder pressure as the excavation load is likely to become excessive. The predetermined cylinder pressure may be either a variable value that varies in accordance with changes in the posture of the excavation attachment or a fixed value that does not vary in accordance with changes in the posture of the excavation attachment.

In response to determining that the excavation load is likely to become excessive when the operating mode is SA (semi-automatic) mode, the determining part 31 determines that the posture of the excavating excavation attachment be corrected and outputs a command to the control valve E1.

In response to receiving the command from the determining part 31, the control valve E1 forces a flow control valve associated with a predetermined cylinder to operate irrespective of the details of an operation input to the operating apparatus 26, thereby forcing the predetermined cylinder to extend or retract. According to this embodiment, for example, even when a boom operating lever is not operated, the control valve E1 forces a flow control valve associated with the boom cylinder 7 to move to force the boom cylinder 7 to extend. As a result, it is possible to reduce the excavation depth by forcing the boom 4 to rise. Alternatively, even when a bucket operating lever is not operated, the control valve E1 may force a flow control valve associated with the bucket cylinder 9 to move to force the bucket cylinder 9 to extend. In this case, it is possible to control a bucket teeth tips angle to reduce the excavation depth by forcing the bucket 6 to close. The bucket teeth tips angle is, for example, the angle of the teeth tips of the bucket 6 to a horizontal plane. Thus, the control valve E1 can reduce the excavation depth by forcing at least one of the boom cylinder 7 and the bucket cylinder 9 to extend or retract.

During deep excavation, however, reducing the excavation depth by forcing the boom 4 to rise or forcing the bucket 6 to close may instead increase an excavation reaction force. Therefore, the determining part 31 causes the correction of the posture of the excavation attachment during deep excavation to differ from the above-described correction during normal excavation.

For example, the determining part 31 determines whether deep excavation or normal excavation is in progress based on the posture of the excavation attachment. The determining part 31 may determine whether deep excavation or normal excavation is in progress based on the posture of the boom 4 or based on the posture of the boom 4 and the posture of the arm 5.

Figure 5A:
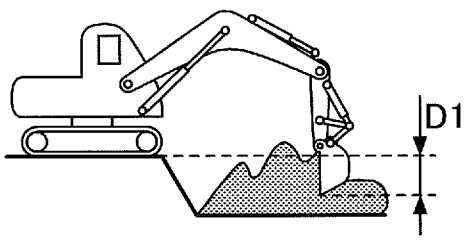
FIGS. 5A through 5C are side views of the shovel, illustrating changes in the posture of the excavation attachment.
Figure 5B:
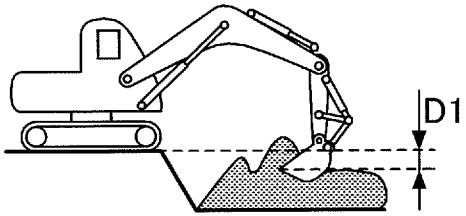
Figure 5C:
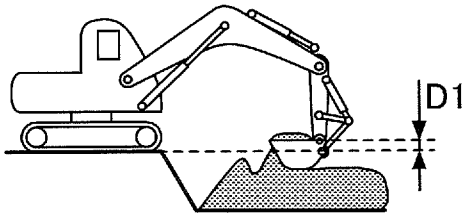
Figure 6A:
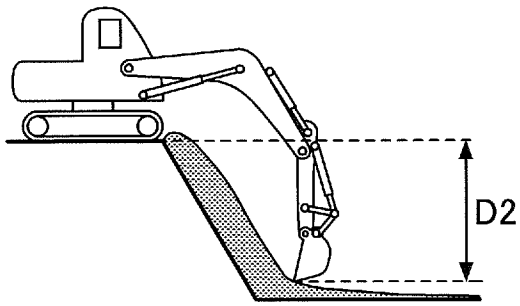
FIGS. 6A through 6C are side views of the shovel, illustrating changes in the posture of the excavation attachment.
Figure 6B:
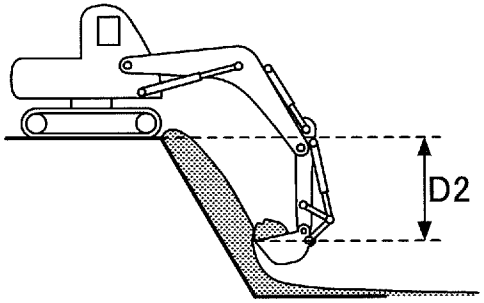
Figure 6C:
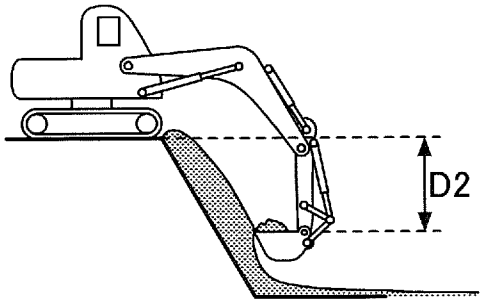

Here, the difference between normal excavation and deep excavation is described with reference to FIGS. 5A through 5C and 6A through 6C. FIGS. 5A through 5C and 6A through 6C are side views of a shovel, illustrating changes in the posture of the excavation attachment. FIGS. 5A through 5C illustrate changes in the posture of the excavation attachment during normal excavation. FIGS. 6A through 6C illustrate changes in the posture of the excavation attachment during deep excavation.

"Normal excavation" means excavation in the case where the moment of an excavation reaction force to roll a shovel forward is unlikely to exceed the moment of the deadweight of the shovel to prevent the shovel from rolling forward, and is typically excavation where an excavation depth D1 is less than a predetermined depth (for example, 2 m) as illustrated in FIGS. 5A through 5C. The excavation depth means, for example, the depth of the point of action of an excavation reaction force from a horizontal plane including a ground surface in which the lower traveling body 1 is in contact. When the point of action of the excavation reaction force is higher than the horizontal plane, the excavation depth is a negative value and means excavation height.

"Deep excavation" means excavation in the case where the moment of an excavation reaction force to roll a shovel forward is likely to exceed the moment of the deadweight of the shovel to prevent the shovel from rolling forward, and is typically excavation where an excavation depth D2 is more than or equal to a predetermined depth (for example, 2 m) as illustrated in FIGS. 6A through 6C. The determining part 31 may determine that it is deep excavation when the boom angle (θ1) is less than a predetermined value, irrespective of the position of a working part, such as the bucket teeth tips position P4.

The determining part 31 determines whether the bucket 6 is in contact with the ground based on, for example, the outputs of the pilot pressure sensors 15*a* and 15*b*, the cylinder pressure sensors S11 through S16, etc., in order to determine whether excavation is in progress.

The determining part 31 derives the bucket teeth tips position P4 based on the detection value of the posture detecting device M1, and when the Z-coordinate value of the bucket teeth tips position P4 is a negative value, sets its absolute value as the excavation depth. The determining part 31 determines that it is deep excavation when the excavation depth is more than or equal to a predetermined depth, and determines that it is normal excavation when the excavation depth is less than the predetermined depth.

Thereafter, the determining part 31 determines whether the excavation load is likely to become excessive. In response to determining that the excavation load is likely to become excessive during normal excavation, the determining part 31 forces the boom cylinder 7 to extend to force the boom 4 to rise as described above.

In contrast, in response to determining that the excavation load is likely to become excessive during deep excavation, the determining part 31 forces the arm cylinder 8 to retract to force the arm 5 to open, instead of forcing the boom 4 to rise. Alternatively, the determining part 31 forces the bucket cylinder 9 to retract to force the bucket 6 to open. The arm 5 and the bucket 6 may be opened simultaneously. This is for reducing an excavation reaction force and because forcing the boom 4 to rise to reduce the excavation depth during deep excavation may instead increase an excavation reaction force.

The determining part 31 may determine whether the excavation load is likely to become excessive, that is, whether the upper turning body 3 is likely to become unstable, during deep excavation based on the output of the body tilt sensor S2 attached to the rear end of the upper turning body 3. This is because the determining part 31 can determine whether the moment of an excavation reaction force to roll the shovel forward is likely to exceed the moment of the deadweight of the shovel to prevent the shovel from rolling forward, based on the inclination of the upper turning body 3. Specifically, in response to detecting the start of the lift of the rear end of the upper turning body 3 based on the output of the body tilt sensor S2, the determining part 31 determines that the excavation load is likely to become excessive, that is, the upper turning body 3 is likely to become unstable.

The determining part 31 may determine whether it is normal excavation or deep excavation after determining that the excavation load is likely to become excessive. The determination as to whether excavation is in progress may be omitted. Alternatively, whether excavation is in progress, whether it is no mal excavation or deep excavation, and whether the excavation load is likely to become excessive may be determined simultaneously.

Figure 7:
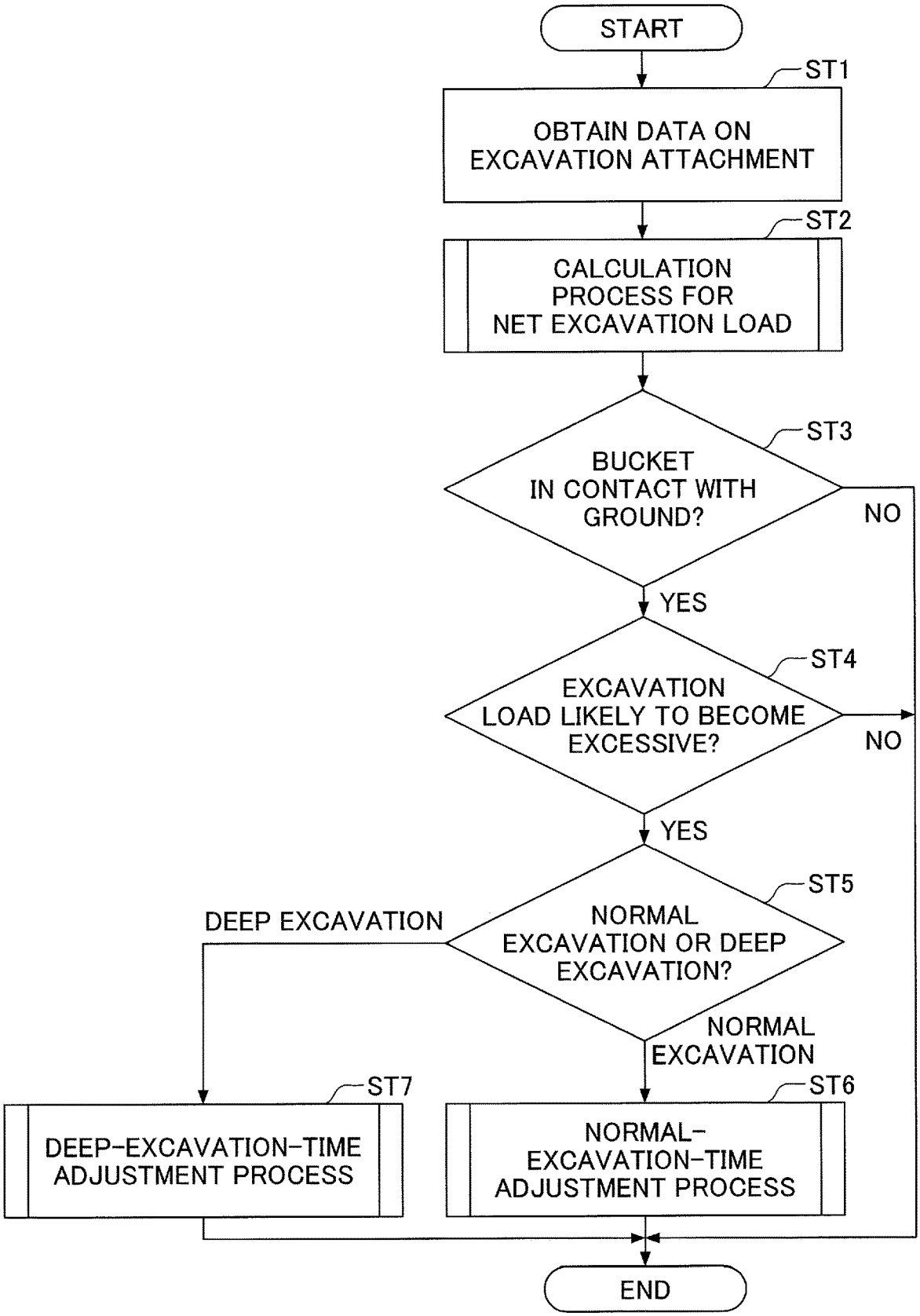
FIG. 7 is a flowchart of a determination process.

Next, a flow of a process of the controller 30 determining whether it is necessary to correct the posture of the excavation attachment during excavation with an arm closing motion (hereinafter, "determination process") is described with reference to FIG. 7. FIG. 7 is a flowchart of the determination process. The controller 30 repeatedly executes this determination process at predetermined control intervals when the operating mode is set to SA (semi-automatic) mode.

First, the determining part 31 of the controller 30 obtains data on the excavation attachment (step ST1). The determining part 31 obtains, for example, the boom angle (θ1), the arm angle (θ2), the bucket angle (θ3), the cylinder pressures (P11 through P16), etc.

Thereafter, the determining part 31 calculates the net excavation load by executing a calculation process for the net excavation load (step ST2). The calculation process is described in detail below.

Thereafter, the determining part 31 determines whether the bucket 6 is in contact with the ground (step ST3), in order to determine whether excavation is in progress. The determining part 31 determines whether the bucket 6 is in contact with the ground based on, for example, the outputs of the pilot pressure sensors 15*a* and 15*b*, the cylinder pressure sensors S11 through S16, etc.

For example, the determining part 31 determines that the bucket 6 is in contact with the ground when the arm bottom pressure (P13), which is the pressure of hydraulic oil in the expansion-side oil chamber during an arm closing operation, is more than or equal to a predetermined value.

Whether an arm closing operation is being performed is determined based on the outputs of the pilot pressure sensors 15*a* and 15*b*.

In response to determining that the bucket 6 is in contact with the ground (YES at step ST3), the determining part 31 determines whether the excavation load is likely to become excessive (step ST4). For example, the determining part 31 determines that the excavation load is likely to become excessive when the net excavation load calculated in the calculation process is more than or equal to a predetermined value (predetermined load). The determining part 31 may determine whether the excavation load is likely to become excessive, that is, whether the upper turning body 3 is likely to become unstable, during deep excavation based on the output of the body tilt sensor S2. Furthermore, the determining part 31 may be configured to change the predetermined load in accordance with the output value of the body tilt sensor S2. Furthermore, the determining part 31 may determine that the excavation load is likely to become excessive when the variation range of the output value of the body tilt sensor S2 is more than or equal to a predetermined determination threshold because of the exertion of force in a direction to lift the counterweight of the upper turning body 3. The variation range of the output value of the body tilt sensor S2 is, for example, the difference between the output value of the body tilt sensor S2 at the time of the determination that the bucket 6 has contacted the ground and the current output value of the body tilt sensor S2.

Furthermore, the determining part 31 may change the determination threshold based on the output value of the body tilt sensor S2 at the time of the determination that the bucket 6 has contacted the ground. For example, even with the same load applied on a working part, the shovel is more likely to become unstable when continuing work while tilting forward on a slope than when continuing work while tilting forward on level ground. Therefore, it is desirable to change the determination threshold based on the inclination of the upper turning body 3.

In response to determining that the excavation load is likely to become excessive (YES at step ST4), the determining part 31 determines whether it is normal excavation or deep excavation (step ST5). For example, the determining part 31 determines whether it is normal excavation or deep excavation based on the posture of the excavation attachment detected by the posture detecting device M1. Specifically, the determining part 31 determines that it is deep excavation when the excavation depth is more than or equal to a predetermined depth and determines that it is normal excavation when the excavation depth is less than the predetermined depth, for example.

In response to determining that it is normal excavation (NORMAL EXCAVATION at step ST5), the determining part 31 determines that it is necessary to correct the posture of the excavation attachment during normal excavation and executes a normal-excavation-time adjustment process (step ST6). For example, the determining part 31 outputs a command to the control valve E1 to force the flow control valve associated with the boom cylinder 7 to move to force the boom cylinder 7 to extend. As a result, irrespective of the presence or absence of an operation input to the boom operating lever, it is possible to reduce the excavation depth by forcing the boom 4 to rise. Alternatively, the determining part 31 may force the flow control valve associated with the bucket cylinder 9 to move to force the bucket cylinder 9 to extend. As a result, irrespective of the presence or absence of an operation input to the bucket operating lever, it is possible to reduce the excavation depth by forcing the bucket 6 to close.

In response to determining that it is deep excavation (DEEP EXCAVATION at step ST5), the determining part 31 determines that it is necessary to correct the posture of the excavation attachment during deep excavation and executes a deep-excavation-time adjustment process (step ST7). For example, the determining part 31 outputs a command to the control valve E1 to force a flow control valve associated with the arm cylinder 8 to move to force the arm cylinder 8 to retract. As a result, irrespective of the presence or absence of an operation input to an arm operating lever, it is possible to reduce the excavation load by forcing the arm 5 to open. Alternatively, the determining part 31 may force the flow control valve associated with the bucket cylinder 9 to move to force the bucket cylinder 9 to retract. As a result, irrespective of the presence or absence of an operation input to the bucket operating lever, it is possible to reduce the excavation load by forcing the bucket 6 to open.

In response to determining that the bucket 6 is not in contact with the ground (NO at step ST3) or in response to determining that the excavation load is unlikely to become excessive (NO at step ST4), the determining part 31 ends the determination process of this time without executing the adjustment process.

According to the example of FIG. 7, the determining part 31 determines whether the excavation load is likely to become excessive after determining that the bucket 6 is in contact with the ground, and determines whether it is normal excavation or deep excavation after determining that the excavation load is likely to become excessive. The determining part 31, however, may determine whether the excavation load is likely to become excessive after determining whether it is normal excavation or deep excavation. Furthermore, the determination as to whether the bucket 6 is in contact with the ground may be omitted.

The determining part 31 determines whether the excavation load is likely to become excessive, while the determining part 31 may determine whether the excavation load is likely to become insufficient. In response to determining that the excavation load is likely to become insufficient as well, the determining part 31 may determine that the correction of the posture of the excavation attachment is necessary and execute the adjustment process.

For example, in response to determining that the excavation load is likely to become insufficient during normal excavation, the determining part 31 outputs a command to the control valve E1 to force the flow control valve associated with the boom cylinder 7 to move to force the boom cylinder 7 to retract. As a result, irrespective of the presence or absence of an operation input to the boom operating lever, it is possible to increase the excavation depth by forcing the boom 4 to lower.

Alternatively, the determining part 31 may force the flow control valve associated with the bucket cylinder 9 to move to force the bucket cylinder 9 to retract. As a result, irrespective of the presence or absence of an operation input to the bucket operating lever, it is possible to increase the excavation depth by forcing the bucket 6 to open.

Figure 8:
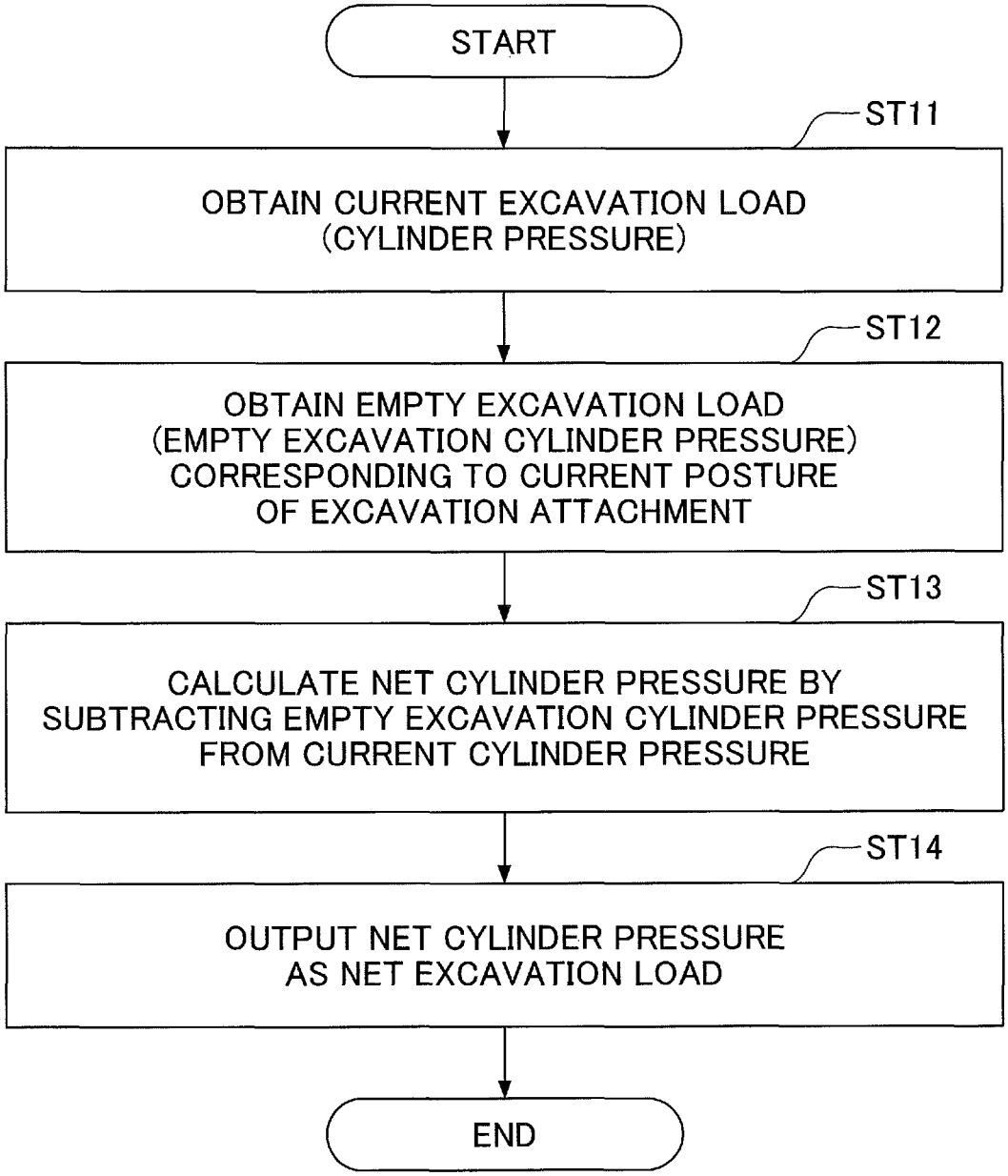
FIG. 8 is a flowchart illustrating a flow of a calculation process.

Next, a flow of the calculation process for the net excavation load is described with reference to FIG. 8. FIG. 8 is a flowchart illustrating a flow of the calculation process.

First, the determining part 31 obtains a cylinder pressure serving as a current excavation load (step ST11). The current cylinder pressure includes, for example, the boom bottom pressure (P11) detected by the cylinder pressure sensor S11. The same is true for the boom rod pressure (P12), the arm bottom pressure (P13), the arm rod pressure (P14), the bucket bottom pressure (P15), and the bucket rod pressure (P16).

Thereafter, the determining part 31 obtains an empty excavation cylinder pressure serving as the empty excavation load, corresponding to the current posture of the excavation attachment (step ST12). For example, the determining part 31 derives a prestored empty excavation cylinder pressure, referring to the empty excavation cylinder pressure table using a current boom angle (θ1), arm angle (θ2), and bucket angle (θ3) as retrieval keys. The empty excavation cylinder pressure includes at least one of, for example, an empty excavation boom bottom pressure, an empty excavation boom rod pressure, an empty excavation arm bottom pressure, an empty excavation atm rod pressure, an empty excavation bucket bottom pressure, and an empty excavation bucket rod pressure.

Thereafter, the determining part 31 calculates a net cylinder pressure by subtracting the empty excavation cylinder pressure corresponding to the current posture of the excavation attachment from the current cylinder pressure (step ST13). The net cylinder pressure includes, for example, a net boom bottom pressure obtained by subtracting the empty excavation boom bottom pressure from the boom bottom pressure (P11). The same is true for a net boom rod pressure, a net arm bottom pressure, a net arm rod pressure, a net bucket bottom pressure, and a net bucket rod pressure.

Thereafter, the determining part 31 outputs the calculated net cylinder pressure as the net excavation load (step ST14).

For example, in the case of having derived six net cylinder pressures as the net excavation load, the determining part 31 determines whether the excavation load is likely to become excessive based on at least one of the six net cylinder pressures. The six net cylinder pressures are the net boom bottom pressure, the net boom rod pressure, the net arm bottom pressure, the net arm rod pressure, the net bucket bottom pressure, and the net bucket rod pressure. For example, the determining part 31 may determine that the excavation load is likely to become excessive when the net arm bottom pressure is more than or equal to a first predetermined pressure value and the net boom bottom pressure is more than or equal to a second predetermined pressure value during the complex operation of arm closing and boom raising. Alternatively, the determining part 31 may determine that the excavation load is likely to become excessive when the net aui bottom pressure is more than or equal to the first predetermined pressure value during the arm closing operation.

Alternatively, the determining part 31 may determine that the excavation load is likely to become excessive when the net boom bottom pressure is more than or equal to the second predetermined pressure value during the boom raising operation.

Figure 9:
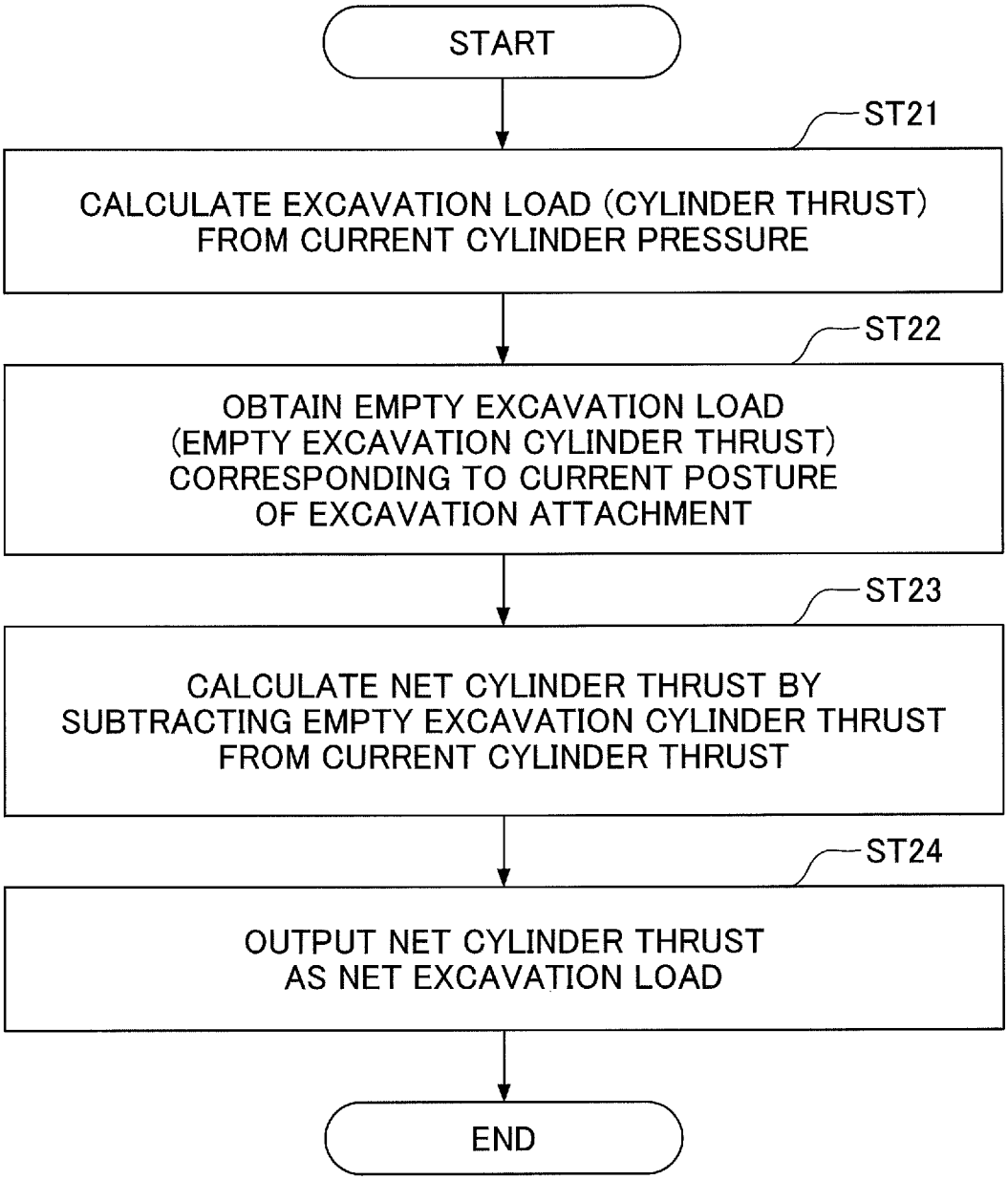
FIG. 9 is a flowchart illustrating another flow of the calculation process.

Next, another example of the calculation process for the net excavation load is described with reference to FIG. 9. FIG. 9 is a flowchart illustrating another flow of the calculation process. The process of FIG. 9 is different from the process of FIG. 8, which employs a cylinder pressure, in using a cylinder thrust as a current excavation load.

First, the determining part 31 calculates a cylinder thrust serving as the excavation load from a current cylinder pressure (step ST21). The current cylinder thrust is, for example, the boom cylinder thrust (f1). The boom cylinder thrust (f1) is the difference between a cylinder extension force and a cylinder retraction force (P11×A11−P12×A12), where the cylinder extension force is the product (P11×A11) of the boom bottom pressure (P11) and the pressure receiving area of a piston in the boom bottom-side oil chamber (A11) and the cylinder retraction force is the product (P12×A12) of the boom rod pressure (P12) and the pressure receiving area of the piston in the boom rod-side oil chamber (A12). The same is true for the arm cylinder thrust (f2) and the bucket cylinder thrust (f3).

Thereafter, the determining part 31 obtains an empty excavation cylinder thrust serving as the empty excavation load, corresponding to the current posture of the excavation attachment (step ST22). For example, the determining part 31 derives a prestored empty excavation cylinder thrust, referring to the empty excavation cylinder thrust table using a current boom angle (θ1), arm angle (θ2), and bucket angle (θ3) as retrieval keys. The empty excavation cylinder thrust includes at least one of, for example, an empty excavation boom cylinder thrust, an empty excavation arm cylinder thrust, and an empty excavation bucket cylinder thrust.

Thereafter, the determining part 31 calculates a net cylinder thrust by subtracting the empty excavation cylinder thrust from the current cylinder thrust (step ST23). The net cylinder thrust includes, for example, a net boom cylinder thrust obtained by subtracting the empty excavation boom cylinder thrust from the boom cylinder thrust (f1). The same is true for a net arm cylinder thrust and a net bucket cylinder thrust.

Thereafter, the determining part 31 outputs the calculated net cylinder thrust as the net excavation load (step ST24).

For example, in the case of having derived three net cylinder thrusts as the net excavation load, the determining part 31 determines whether the excavation load is likely to become excessive based on at least one of the three net cylinder thrusts. The three net cylinder thrusts are the net boom cylinder thrust, the net arm cylinder thrust, and the net bucket cylinder thrust. For example, the determining part 31 may determine that the excavation load is likely to become excessive when the net arm cylinder thrust is more than or equal to a first predetermined thrust value and the net boom cylinder thrust is more than or equal to a second predetermined thrust value. Alternatively, the determining part 31 may determine that the excavation load is likely to become excessive when the net arm cylinder thrust is more than or equal to the first predetermined thrust value.

Alternatively, in the case of having derived three net excavation torques as the net excavation load, the determining part 31 may determine whether the excavation load is likely to become excessive based on at least one of the three net excavation torques. The three net excavation torques are a net boom excavation torque, a net arm excavation torque, and a net bucket excavation torque. For example, the determining part 31 may determine that the excavation load is likely to become excessive when the net arm excavation torque is more than or equal to a first predetermined torque value and the net boom excavation torque is more than or equal to a second predetermined torque value. Alternatively, the determining part 31 may determine that the excavation load is likely to become excessive when the net arm excavation torque is more than or equal to the first predetermined torque value.

Figure 10:
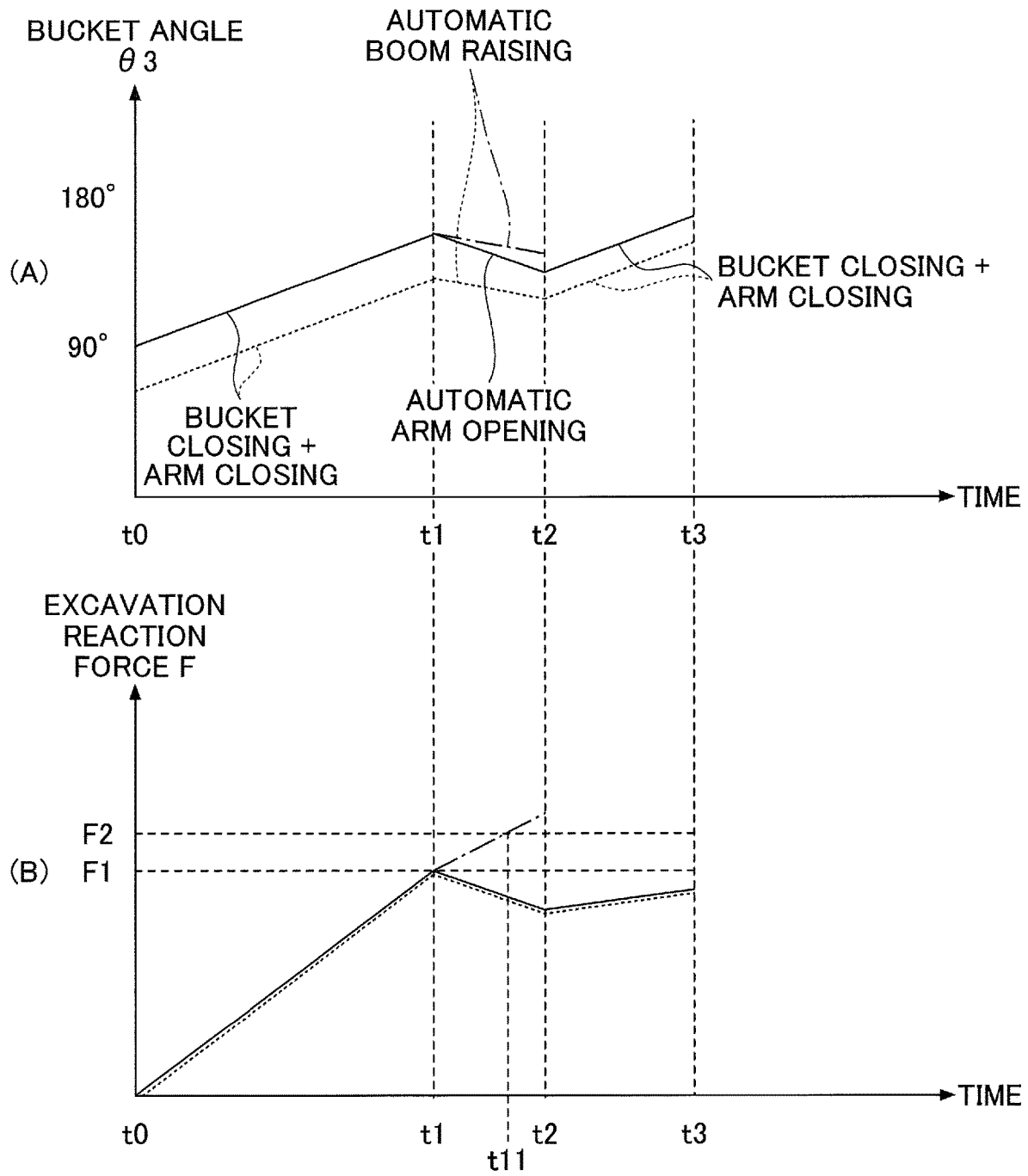
FIG. 10 shows graphs illustrating changes over time in a bucket angle and an excavation reaction force, respectively, during the complex operation of arm closing and boom raising.

Next, changes over time in the bucket angle (θ3) and the excavation reaction force F during the complex operation of arm closing and boom raising are described with reference to FIG. 10. In FIG. 10, (A) illustrates changes over time in the bucket angle (θ3), and (B) illustrates changes over time in the excavation reaction force F. In FIG. 10, the solid line indicates changes during deep excavation and the dashed line indicates changes during normal excavation.

A shovel operator brings the teeth tips of the bucket 6 into contact with the ground at time t0, and performs excavation from time t0 to time t3 while closing the arm 5 and the bucket 6.

The bucket angle (θ3) increases from time t0 to time t1 irrespective of whether it is normal excavation or deep excavation. Likewise, the excavation reaction force F increases from time t0 to time t1 to reach a value F1 irrespective of whether it is normal excavation or deep excavation.

The determining part 31 determines at time t0 that the bucket 6 is in contact with the ground, and when determining at time t1 that the excavation load is likely to become excessive, determines whether it is normal excavation or deep excavation.

In response to determining at time t1 that it is normal excavation, the determining part 31 forces the boom cylinder 7 to extend to force the boom 4 to rise, irrespective of an operation input to the operating apparatus 26.

As the boom 4 is forced to rise, the bucket angle (θ3) decreases from time t1 to time t2 as indicated by the dashed line in (A) of FIG. 10, and the excavation reaction force F decreases from time t1 to time t2 as indicated by the dashed line in (B) of FIG. 10. This is because the excavation depth is reduced.

In response to determining at time t1 that it is deep excavation, the determining part 31 forces the arm cylinder 8 to retract to force the arm 5 to open, irrespective of an operation input to the operating apparatus 26. This is because forcing the boom to rise the same as in normal excavation might instead increase the excavation reaction force F. The one-dot chain line in (B) of FIG. 10 indicates changes in the excavation reaction force F in the case of forcing the boom 4 to rise in response to determining that it is deep excavation. In this case, the excavation reaction force F would increase from time t1 to time t11 to reach a value F2. The value F2 is, for example, the value of the excavation reaction force F when the rear end of the shovel lifts up.

When the arm 5 is forced to open, the bucket angle (θ3) decreases from time t1 to time t2 as indicated by the solid line in (A) of FIG. 10. FurtheLinore, the excavation reaction force F decreases from time t1 to time t2 as indicated by the solid line in (B) of FIG. 10.

When the boom 4 is raised a predetermined boom angle during normal excavation, the determining part 31 stops its rising motion. Likewise, when the arm 5 is opened a predetermined arm angle during deep excavation, the determining part 31 stops its opening motion.

Thereafter, as excavation according to the operator's complex operation continues, the bucket angle (θ3) increases from time t2 to time t3 irrespective of whether it is normal excavation or deep excavation. Likewise, the excavation reaction force F increases from time t2 to time t3 irrespective of whether it is normal excavation or deep excavation.

According to the above-described configuration, the controller 30 can determine whether the excavation load is likely to increase excessively with high accuracy by deriving a current net excavation load with high accuracy. In response to determining that the excavation load is likely to increase excessively, the controller 30 can automatically correct the posture of the excavation attachment so that the excavation load decreases. As a result, it is possible to prevent the excavation attachment from stopping moving because of overload during an excavating operation, so that it is possible to achieve an efficient excavating operation.

Furthermore, the controller 30 can determine whether the excavation load is likely to decrease excessively with high accuracy by deriving a current net excavation load with high accuracy. In response to determining that the excavation load is likely to decrease excessively, the controller 30 can automatically correct the posture of the excavation attachment so that the excavation load increases. As a result, it is possible to prevent the amount of excavation per excavating operation from being excessively small, so that it is possible to achieve an efficient excavating operation.

Thus, the controller 30 can automatically correct the posture of the excavation attachment during an excavating operation so that the excavation reaction force is appropriate in size. Therefore, it is possible to prevent the posture, behavior, etc., of the shovel from becoming unstable, so that it is possible to achieve accurate positioning control for the teeth tips of the bucket 6.

Furthermore, the controller 30 can correct the posture of the excavation attachment differently between normal excavation and deep excavation. Therefore, it is possible to prevent an increase in the excavation reaction force due to the forced rise of the boom 4 during deep excavation.

Furthermore, the controller 30 can calculate the excavation reaction force, taking not only the bucket excavation torque but also the boom excavation torque and the arm excavation torque into account. Therefore, it is possible to calculate the excavation reaction force with higher accuracy.

An embodiment of the present invention is described in detail above. The present invention, however, is not limited to the above-described embodiment. Various variations, replacements, etc., may be applied to the above-described embodiment without departing from the scope of the present invention. Furthermore, separately described features may be combined as long as causing no technical contradiction.

For example, according to the above-described embodiment, a cylinder pressure sensor is employed as an example of the instability detecting device, while other sensors such as a torque sensor may be employed as instability detecting devices.

What is claimed is:

1. A shovel comprising:

a lower traveling body;

an upper turning body mounted on the lower traveling body;

an excavation attachment attached to the upper turning body;

a posture detecting device configured to detect a posture of the excavation attachment;

an instability detecting device configured to detect information on instability of the upper turning body due to an excavation load; and a hardware processor configured to correct the posture of the excavation attachment, wherein the hardware processor is configured to open an arm or a bucket of the excavation attachment in response to determining, based on outputs of the posture detecting device and the instability detecting device, that the excavation load during deep excavation is more than or equal to a predetermined value, and the hardware processor is configured to determine whether the deep excavation is in progress based on at least a posture of a boom of the excavation attachment.

2. The shovel as claimed in claim 1, wherein the hardware processor is configured to calculate an excavation reaction force based on the posture of the excavation attachment and the excavation load, and determine whether the excavation load is more than or equal to the predetermined value based on the calculated excavation reaction force.

3. The shovel as claimed in claim 1, wherein the hardware processor is configured to determine whether the excavation load is more than or equal to the predetermined value based on a boom cylinder pressure.

4. The shovel as claimed in claim 1, wherein the hardware processor is configured to determine whether the excavation load is more than or equal to the predetermined value based on an atm cylinder pressure.

5. The shovel as claimed in claim 1, wherein the hardware processor is configured to determine whether the excavation load is more than or equal to the predetermined value based on an inclination of the upper turning body.

6. The shovel as claimed in claim 1, wherein the instability detecting device includes a body tilt sensor.

7. The shovel as claimed in claim 1, wherein the hardware processor is configured to change the predetermined value in accordance with an output value of a body tilt sensor.

8. A shovel comprising:

a lower traveling body;

an upper turning body mounted on the lower traveling body;

an excavation attachment attached to the upper turning body;

a posture detecting device configured to detect a posture of the excavation attachment;

an instability detecting device configured to detect information on instability of the upper turning body due to an excavation load; and a hardware processor configured to correct the posture of the excavation attachment, wherein the hardware processor is configured to calculate the excavation load based on outputs of the posture detecting device and the instability detecting device, and control an arm or a bucket of the excavation attachment in response to determining that the excavation load during deep excavation is more than or equal to a predetermined value, and the hardware processor is configured to determine whether the deep excavation is in progress based on at least a posture of a boom of the excavation attachment.

9. The shovel as claimed in claim 8, wherein the hardware processor is configured to calculate an excavation reaction force based on the posture of the excavation attachment and the excavation load, and determine whether the excavation load is more than or equal to the predetermined value based on the calculated excavation reaction force.

10. The shovel as claimed in claim 8, wherein the hardware processor is configured to determine whether the excavation load is more than or equal to the predetermined value based on a boom cylinder pressure.

11. The shovel as claimed in claim 8, wherein the hardware processor is configured to determine whether the excavation load is more than or equal to the predetermined value based on an atm cylinder pressure.

12. The shovel as claimed in claim 8, wherein the hardware processor is configured to determine whether the excavation load is more than or equal to the predetermined value based on an inclination of the upper turning body.

13. The shovel as claimed in claim 8, wherein the instability detecting device includes a body tilt sensor.

14. The shovel as claimed in claim 8, wherein the hardware processor is configured to change the predetermined value in accordance with an output value of a body tilt sensor.

* * * * *